US007043069B1

(12) United States Patent
Heinrich et al.

(10) Patent No.: US 7,043,069 B1
(45) Date of Patent: May 9, 2006

(54) QUALITY ASSURANCE DURING THERMAL SPRAY COATING BY MEANS OF COMPUTER PROCESSING OR ENCODING OF DIGITAL IMAGES

(75) Inventors: Peter Heinrich, Germering (DE); Werner Kroemmer, Landshut (DE); Klaus Landes, Munich (DE); Jochen Zierhut, Ottobrunn (DE); Tilo Streibl, Neubiberg (DE)

(73) Assignee: Linde Gas Aktiengesellschaft, Hoellriegelskreuth (DE)

( * ) Notice: Subject to any disclaimer, the term of this patent is extended or adjusted under 35 U.S.C. 154(b) by 0 days.

(21) Appl. No.: 09/524,755

(22) Filed: Mar. 13, 2000

(30) Foreign Application Priority Data

Mar. 11, 1999 (DE) ..... 199 10 892

(51) Int. Cl.
*G06K 9/00* (2006.01)

(52) U.S. Cl. ..... 382/141; 382/141; 219/121.36; 427/446

(58) Field of Classification Search ..... 382/108, 382/141, 143, 144, 147, 149, 152, 190, 199, 382/232, 266; 427/9, 446, 557, 180, 207.1, 427/212, 248.1, 256, 331, 421, 422, 450, 427/564; 219/121.48, 121.47, 121.55, 121.68, 219/609, 121.5, 121.36; 118/313, 663, 667, 118/712, 723 EB; 250/559.4, 524, 504 R; 89/7; 503/227
See application file for complete search history.

(56) References Cited

U.S. PATENT DOCUMENTS

| | | | | |
|---|---|---|---|---|
| 4,661,682 | A * | 4/1987 | Gruner et al. | 219/121.47 |
| 4,962,461 | A * | 10/1990 | Meyer et al. | 438/8 |
| 5,047,612 | A * | 9/1991 | Savkar et al. | 219/121.47 |
| 5,171,393 | A * | 12/1992 | Moffat | 427/422 |

(Continued)

FOREIGN PATENT DOCUMENTS

| | | | |
|---|---|---|---|
| DE | 3515209 | A1 | 10/1985 |
| DE | 19820195 | A1 | 11/1999 |
| EP | 08269672 | | 10/1996 |
| EP | 0955389 | A1 | 5/1999 |

OTHER PUBLICATIONS

*VII Finnish Conference on Physics in Industry*, Nov. 1-2, 1995, Tampere, Finland entitled "Real-Time Optical Spray Pattern Diagnostics for Thermal Spraying" by T. Lehtinen et al.

(Continued)

*Primary Examiner*—Sheela Chawan
(74) *Attorney, Agent, or Firm*—Crowell & Moring LLP

(57) ABSTRACT

A thermal spray coating method for creating a coating layer on a surface of a substrate is monitored by determining characteristics of the thermal spray coating as it affects the quality of the coating layer by recording, controlling, and monitoring through a digital camera whose image is analyzed and characterized.

16 Claims, 3 Drawing Sheets

U.S. PATENT DOCUMENTS

| | | | | | |
|---|---|---|---|---|---|
| 5,171,613 | A | * | 12/1992 | Bok et al. | 427/422 |
| 5,489,820 | A | * | 2/1996 | Ivanov et al. | 315/111.51 |
| 5,518,178 | A | * | 5/1996 | Sahoo et al. | 239/13 |
| 5,633,123 | A | * | 5/1997 | Hill et al. | 219/121.68 |
| 5,658,796 | A | | 8/1997 | Rossi, Jr. et al. | 435/280 |
| 5,757,498 | A | * | 5/1998 | Klein, II et al. | 239/1 |
| 5,912,471 | A | * | 6/1999 | Schutz | 250/559.4 |
| 6,001,426 | A | * | 12/1999 | Witherspoon et al. | 427/449 |
| 6,190,727 | B1 | * | 2/2001 | Thaggard | 427/9 |

OTHER PUBLICATIONS

*Proceedings of the XXX Annual Conference of the Finnish Physical Society* entitled "In-Flight Particle Visualisation in Thermal Plasma Spraying Using an Intensified CCD Camera" by T. Lehtinen et al.

*Proceedings of the XXXI Annual Conference of the Finnish Physical Societ*, Mar. 13-15, 1997, Helsinki, Finland entitled In-Flight Particle Concentration Measurements in Thermal Plasma Spraying Using a CCD Camera by T. Lehtinen et al.

T. Lehtinen, et al., "Correlations Between In-Flight Particle Concentrations and Coating Properties in Atmospheric Plasma Spraying of Alumina" pp. 525-530.

*Optics Day '97—Proceedings Finnish Optical Society Tampere University of Technology*, Feb. 21, 2997, Tampere, Finland entitled Optical Spray Pattern Diagnostics for Thermal Spraying by T. Lehtinen et al.

Klaus Voss and Herbert Suesse, "Invariant Fitting of Planar Objects by Primitives", 1997, pp. 80-84.

* cited by examiner

RESULT: DATA BANK

| | | | | |
|---|---|---|---|---|
| sx1:0.05635 | sy1:0.00332 | ang1:0.00251 | a1:0.90845 | b1:5.44042 |
| sx2:0.06343 | sy2:0.00631 | ang2:0.00089 | a2:5.63184 | b2:6.53315 |
| sx3:0.65433 | sy3:0.00123 | ang3:0.00068 | a3:9.81134 | b3:5.54042 |
| ... | ... | ... | ... | ... |

QUALITY ASSURANCE DURING THERMAL SPRAY COATING BY MEANS OF COMPUTER PROCESSING OR ENCODING OF DIGITAL IMAGES

BACKGROUND AND SUMMARY OF THE INVENTION

This application claims the priority of German Patent Document 199 10 892.7, filed Mar. 11, 1999, the disclosure of which is expressly incorporated by reference herein.

The present invention concerns a thermal spray coating method for creating a coating layer on the surface of a substrate, wherein at least one characteristic of the thermal spray coating method affecting the quality of the coating layer is recorded, controlled, and/or monitored by a digital camera. The present invention also concerns a device for quality assurance when creating a coating layer on the surface of a substrate by thermal spray coating which comprises a digital camera for recording, controlling, and/or monitoring at least one characteristic of the thermal spray coating method affecting the quality of the coating layer.

In the thermal spray coating method, typically an additive is melted onto or applied in molten form with the aid of a gas or gas mixture to the surface of the substrate to be coated.

A method and a device of this kind are described in our German patent application 198 20 195.8. The starting point in that application was to guarantee reproducibility; achievement of quality demands; and adherence to prescribed quality requirements by recording, controlling, and/or monitoring the parameters in thermal spray coating. To do so, relevant process parameters are measured, controlled and perhaps also documented. Such parameters could be, for example, gas flows (carrier gas and/or perhaps fuel gas); current strengths; the spraying distance; the spraying angle (angle between the coating jet and the substrate surface); the velocity of the coating jet relative to the substrate surface; the quantity of additive taken up; the quantity of sprayed powder or the wire feed rate; and the like.

Within the scope of this present invention, all known variants of thermal spray coating would in principle be feasible as process variants, for example, autogenous flame coating, high velocity flame coating, plasma coating, electric arc coating, detonation coating or laser coating, and also the thermal coating variant known as cold gas coating, which is a type of further development of high velocity coating (for example, as described in the European patent specification EP 0 494 533 B1). In cold gas coating, an additive is in powder form in which the powder particles are not melted in the gas jet during cold gas coating. Instead, the temperature of the gas jet is kept below the melting point of the additive powder particles.

In the device as described in our German patent application 198 20 195.9, a digital camera is provided for recording, controlling, and/or monitoring at least one characteristic of the thermal spray coating method affecting the quality of the coating layer. The digital cameras could be either digital image cameras or digital video cameras. The required recording, controlling, and/or monitoring could therefore be achieved by single images and/or video images combined together as sequences to make a film. The boundary between single images on the one hand and film on the other hand is not sharply defined. The lower limit for the frame frequency can be regarded as approximately 16 images per second given the slow response of the human eye.

The diagnostic for recording, controlling, and/or monitoring of characteristics of the thermal spray coating method affecting the quality of the coating layer, as described in our German patent application 198 20 195.9, allows quality assurance of the thermal coating process with relatively little effort yet with exceptional efficiency. So, for example, in companies where thermal coating is used and at the same time frequent changing of coating applications arises, the reproducibility of the coating layer can be guaranteed, and consistent quality of the coating layers very quickly achieved by a diagnostic that evaluates quality-influencing characteristics or parameters and/or quantitatively measures the spray coating method using image standards. It is important, due to the purely optical approach used, that the recording, controlling, and/or monitoring of the quality characteristics in no way whatsoever adversely affects the thermal spray coating method or damages the coating layer in any way. On the other hand, for example, it can be guaranteed even after a longer period of time that the same application is coated with the same coating accuracy if, for example, the characteristics of the image in the melting zone are identical to the previous ones.

The recording, controlling, and/or monitoring by a digital camera can be used to control and, if necessary, optimize one or more parameters. With digital technology, it is completely unproblematic to display and/or evaluate, during the running spray coating process, the recordings made for the purpose of recording, controlling, and/or monitoring the quality of the coating layer so that optimized control of the spray coating parameters can take place. This optimization of the parameters contributes to the economic efficiency of the thermal spray coating method because an ineffective high consumption of one or more of the materials required by the thermal spray coating method (e.g., gas volumes, additives) is avoided, thus allowing savings to be achieved.

In doing so, advantage can be taken of the many display possibilities that digital technology provides. Depending on the individual case, the various display variants—in particular computer processing or encoding—can provide particular advantages. The images or video recordings can in principle be presented in black and white or color. Mixed forms with, for example, partial color representation are also possible.

The task of the present invention is to provide a method and a device as described at the outset wherein the computer processing and/or encoding has been further developed and improved. In particular, the volume of information upon which the diagnostic is based is to be kept as small as possible or reduced so as to simplify handling, speed, and/or data storage.

Other objects, advantages and novel features of the present invention will become apparent from the following detailed description of the invention when considered in conjunction with the accompanying drawing.

DETAILED DESCRIPTION OF THE PREFERRED EMBODIMENT

Figure 1A:
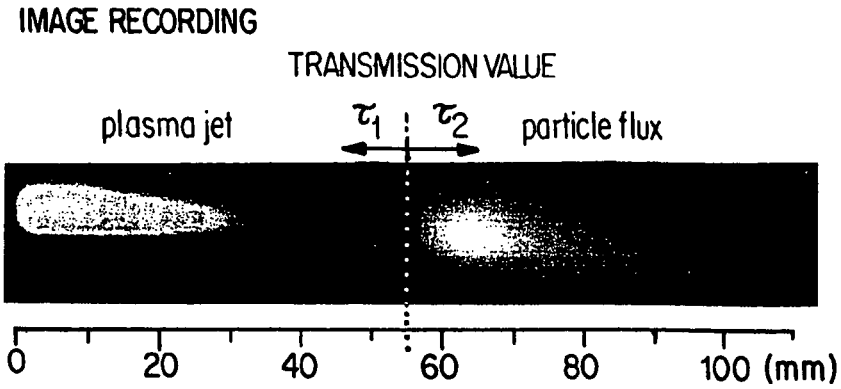
FIG. 1 shows the individual stages of an image processing method for quality assurance in thermal spray coating in accordance with the present invention as a series of images.
Figure 1B:
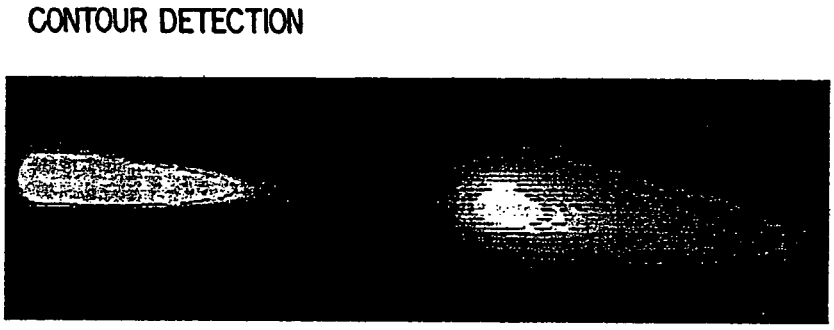
Figure 1C:
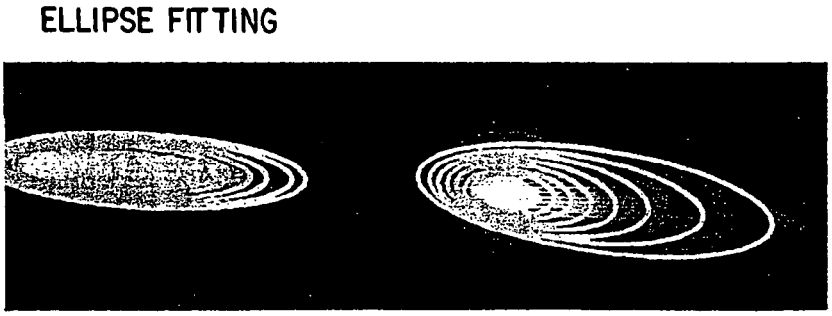
Figures 1D, 1E:
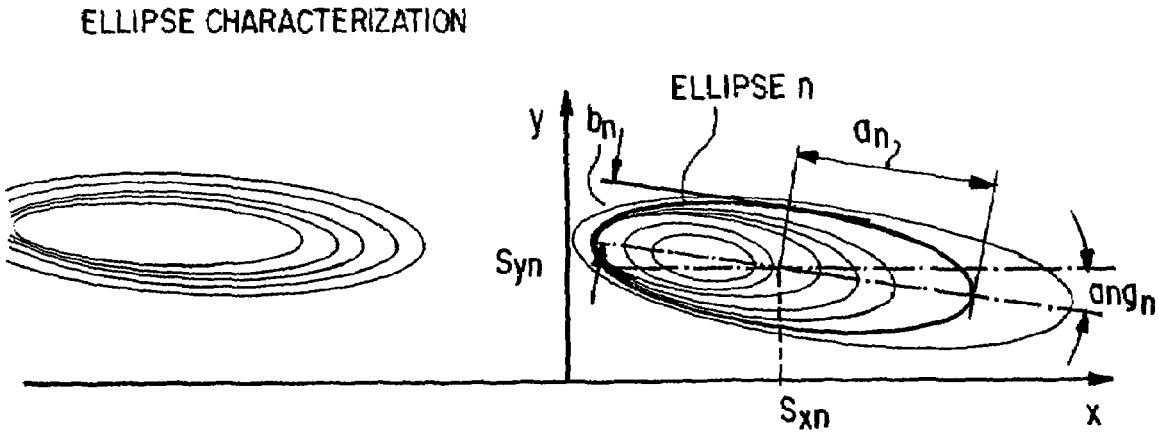

In the images according to the method of the present invention, at least one area of equal intensity and/or at least one area within a particular intensity interval is assigned to one or more symmetric geometrical surface regions by computer processing and/or encoding.

In the device according to the present invention, means are provided for recording the one or more symmetric geometrical surface regions as a data record or records, based on the typical characteristics of the respective geometric shape, whereby at least one of the characteristics of the spray coating method affecting the quality of this coating layer can be stored, controlled, and/or monitored by means of this data record or these data records.

The symmetry of the geometrical surface regions includes, within the scope of the present invention, axial symmetry and rotational symmetry.

In designing the present invention, the one or more symmetric geometrical surface regions are recorded as a data record or data records based on the typical characteristics for the respective geometric shape and at least one of the characteristics of the thermal spray coating method affecting the quality of the coating layer is recorded, controlled, and/or monitored by this data record or data records.

The particular symmetric geometrical surface regions used are circles, squares, rectangles, parallelogram, and/or ellipses. Of those, ellipses are preferentially used because oval structures are formed as a rule which, because of their similar contour to ellipses, can be recorded easily and relatively precisely.

It is advantageous to record independent typical characteristics as a data record for the respective geometric shape. This helps to keep the quantity of data small and to obtain the most respective data possible.

The computer processing and/or encoding is preferably carried out by a contour detection algorithm; by a gradient steps representation; and/or by a gradient accentuating representation reduced to bit planes.

The at least one characteristic of the thermal spray coating method affecting the quality of the coating layer could relate to the spray coating method itself and/or the spraying device being used.

The symmetric geometrical surface regions or preferably their data records can be used to control and possibly optimize one or more parameters.

It is also possible for the symmetric geometrical surface regions or preferably their data records to be used to document one or more of the characteristics affecting the quality of the coating layer and/or the spray coating method itself.

The present invention enables quality assurance by a diagnostic on the basis of relatively (with regard to the large number of parameters in thermal spray coating) small quantities of data and based on representative and unique data for the spray coating method or the spraying device.

With regard to the spraying device (burner) the following conclusions can be drawn directly from the geometrical surface regions or preferably their data records:

for the plasma burner example (plasma coating):
- state of the electrodes,
- enthalpy changes in the free jet, and
- the enthalpy distribution in the free jet.

for the HVOF burner example (high velocity flame coating):
- velocity of the discharged gas (separation of the ultrasonic nodes),
- enthalpy changes in the free jet, and
- the enthalpy distribution in the free jet.

The following characteristics of the spray coating method (i.e. the particular jet) can, for example, be recorded from the geometrical surface regions or preferably their data records: (1) melting behavior; (2) aperture; (3) center-of-mass; and (4) direction.

The present invention will now be described in more detail with the aid of an example. FIG. 1 shows the individual stages of an image processing method for quality assurance in thermal spray coating in accordance with the present invention (e.g., plasma coating) as a series of images. The individual stages are:

1. Image recording,
2. Contour detection,
3. Ellipse fitting,
4. Ellipse characterization, and
5. Database.

The sequence of images is based on a computer processing and/or encoding method in accordance with the present invention.

Areas of equal intensity in the exposed image sections are marked by a contour detection algorithm, a gradient steps representation, or a gradient accentuating representation reduced to bit planes. This information, representative of both the state and the operation of the spraying device (burner) and of the state and progress of the spray coating method are then used as information carriers for further processing.

One or more ellipses are fitted to the resulting oval structures. In doing so, each ellipse is fully characterized by means of its five independent properties. The properties are:

- vertical position of the ellipse center-of-mass,
- horizontal position of the ellipse center-of-mass,
- length of semi-axis 1,
- length of semi-axis 2, and
- angle of one of the semi-axes to the horizontal.

Figure 2:
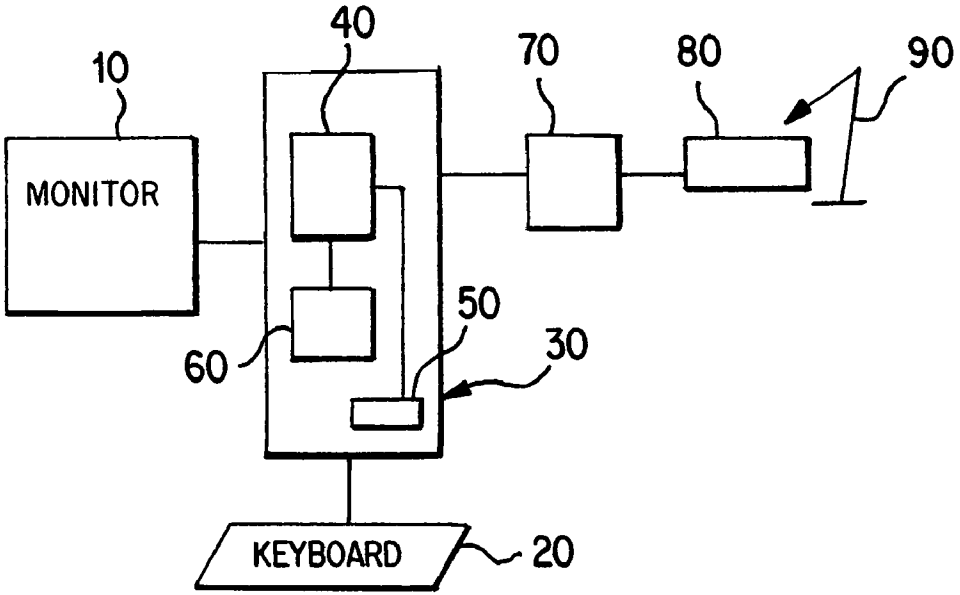
FIG. 2 is a system for generating the digital image processing according to the present invention.

FIG. 2 illustrates an arrangement to accomplish the imaging and processing of the present invention. A digital camera records images of thermal spray coating of a substrate 80 by way of a sprayer 90. The digital images captured by camera 70 are fed to a computer 30 having a microprocessor 40, ROM 60 and a storage device 50 in the form of a CD, CD-ROM, floppy disk, or other media. A keyboard 20 and a monitor 10 complete the system.

Figure 3:
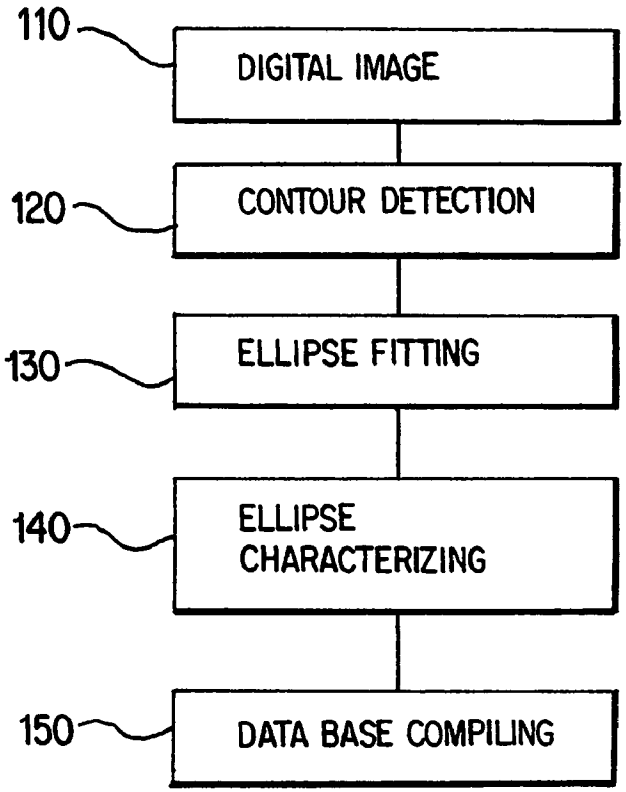
FIG. 3 is a flow chart detaching the image processing according to the present invention.

The processing of the digital image from the camera 7 is detailed in FIG. 3 wherein the digital image 110 is fed to a contour detector 120 which provides an outline of the geometric shape. The resulting contour is analyzed and compared to a series of ellipses at 130 to find the closest fit for particular portions of the region of the image. The resulting closest fitting chosen ellipses are then subjected to analysis at 140 to determine their characteristics including the five above discussed independent properties.

The computer processed or encoded image representation leads to a data record 150 of these independent properties of one or more ellipses which, with regard to quality assurance in thermal spray coating method (in a wider sense), characterizes both the spraying device and the spray coating method itself (in a narrower sense).

By this means the information of the entire spray coating method can be reduced to a small quantity of very representative, unique information that allows a simple, mathematically supported process diagnostic to be realized.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A thermal spray coating method, comprising the steps:

recording of images of real powder particles of at least one of a plasma jet and a particle jet for thermal spray coating;

assigning the images of said real powder particles of at least one of the plasma jet and the particle jet from at least one region of equal intensity or at least one region within a particular intensity level to one or more symmetric geometrical surface regions by computer processing or encoding to provide monitoring of quality of a thermal spray process.

2. The method according to claim 1, wherein said one or more symmetric geometrical surface regions of the image are recorded as data records based on typical characteristics for the respective geometrical shape and at least one of recording, controlling and monitoring at least one of the characteristics of thermal spray coating method effecting the quality of the coating layer as a function of said data record.

3. The method of claim 2, wherein independent typical characteristics are recorded as a data record for the respective geometrical shape.

4. The method of claim 3, wherein at least one characteristic of the thermal spray coating method affecting the quality of the coating layer relates to the spray coating method and/or the spraying device.

5. The method of claim 2, wherein at least one characteristic of the thermal spray coating method affecting the quality of the coating layer relates to the spray coating method and/or the spraying device.

6. The method of claim 5, wherein at least one characteristic of the thermal spray coating method affecting the quality of the coating layer relates to the spray coating method and/or the spraying device.

7. The method of claim 2, wherein the symmetric geometrical surface region is selected from one or more of circles, squares, rectangles, parallelograms and ellipses.

8. The method of claim 2, wherein the computer processing and/or encoding occurs by means of a contour detection algorithm, by means of a gradient steps representation and/or a gradient accentuating representation reduced to bit planes.

9. The method of claim 1, wherein the symmetric geometrical surface region is selected from one or more of circles, squares, rectangles, parallelograms and ellipses.

10. The method of claim 9, wherein the symmetric geometrical surface region is an ellipse.

11. The method of claim 10, wherein independent typical characteristics are recorded as a data record for the respective geometrical shape.

12. The method of claim 10, wherein the computer processing and/or encoding occurs by means of a contour detection algorithm, by means of a gradient steps representation and/or a gradient accentuating representation reduced to bit planes.

13. The method of claim 9, wherein independent typical characteristics are recorded as a data record for the respective geometrical shape.

14. The method of claim 9, wherein the computer processing and/or encoding occurs by means of a contour detection algorithm, by means of a gradient steps representation and/or a gradient accentuating representation reduced to bit planes.

15. The method of claim 1, wherein the computer processing and/or encoding occurs by means of a contour detection algorithm, by means of a gradient steps representation and/or a gradient accentuating representation reduced to bit planes.

16. The method of claim 15, wherein at least one characteristic of the thermal spray coating method affecting the quality of the coating layer relates to the spray coating method and/or the spraying device.

* * * * *